United States Patent [19]

Hill

[11] 4,419,670

[45] Dec. 6, 1983

[54] DUAL FEED BOX HORN ANTENNA

[75] Inventor: Stewart C. Hill, Leicester, England

[73] Assignee: The Marconi Company Limited, Chelmsford, England

[21] Appl. No.: 320,684

[22] Filed: Nov. 12, 1981

[30] Foreign Application Priority Data

Nov. 13, 1980 [GB] United Kingdom ..... 8036535

[51] Int. Cl.[3] ..... H01Q 25/00; H01Q 19/17

[52] U.S. Cl. ..... 343/779; 343/785; 343/786

[58] Field of Search ..... 343/779, 785, 786, 840

[56] References Cited

U.S. PATENT DOCUMENTS 2,912,695 11/1959 Cutler ..... 343/786

4,199,764 4/1980 Frosch ..... 343/786

*Primary Examiner*—E. Lieberman

*Attorney, Agent, or Firm*—Spencer & Frank

[57] ABSTRACT

A radar antenna includes a box horn radiator which is capable of simultaneously transmitting X band and S band signals. The S band signals are transmitted as a resultant of the $TE_{01}$ and $TE_{03}$ mode, which is generated within the box horn. Additionally, the X band frequencies are fed into an off-set input port, which launches the X band signal as a surface wave. By positioning the box horn at the focus of a reflector, azimuth pointing errors are prevented but different elevation patterns are produced.

6 Claims, 3 Drawing Figures

DUAL FEED BOX HORN ANTENNA

This invention relates to antennas which are suitable for radiating signals in a very wide frequency range. The invention is particularly applicable to radar antennas in which two radar signals are transmitted at significantly different frequencies. For example, S band radar frequencies are generally used for long range surveillance purposes, whereas the X band radar frequencies are more commonly used for short range purposes. The need to use both the S and X bands can arise in naval applications, for example, in which the higher frequency X band is used for navigation purposes. It has proved difficult to provide a single antenna which is capable of handling both frequency bands as the provision of two quite separate antenna feed arrangements means that both cannot be physically located exactly at the focus of the antenna and this can give rise to azimuth pointing errors.

According to this invention, an antenna includes a reflector and a box horn positioned at the focus of said reflector so as to illuminate it, the body of the box horn being dimensioned to support the $TE_{01}$ and the $TE_{03}$ modes of a signal applied to a first input port thereof and to direct the resultant signal towards said reflector; and a second input port off-set from the axis of the box horn and being arranged to accept a higher frequency than said first port, one wall of the box horn being arranged to launch said higher frequency as a surface wave directed towards said reflector.

Figure 1:
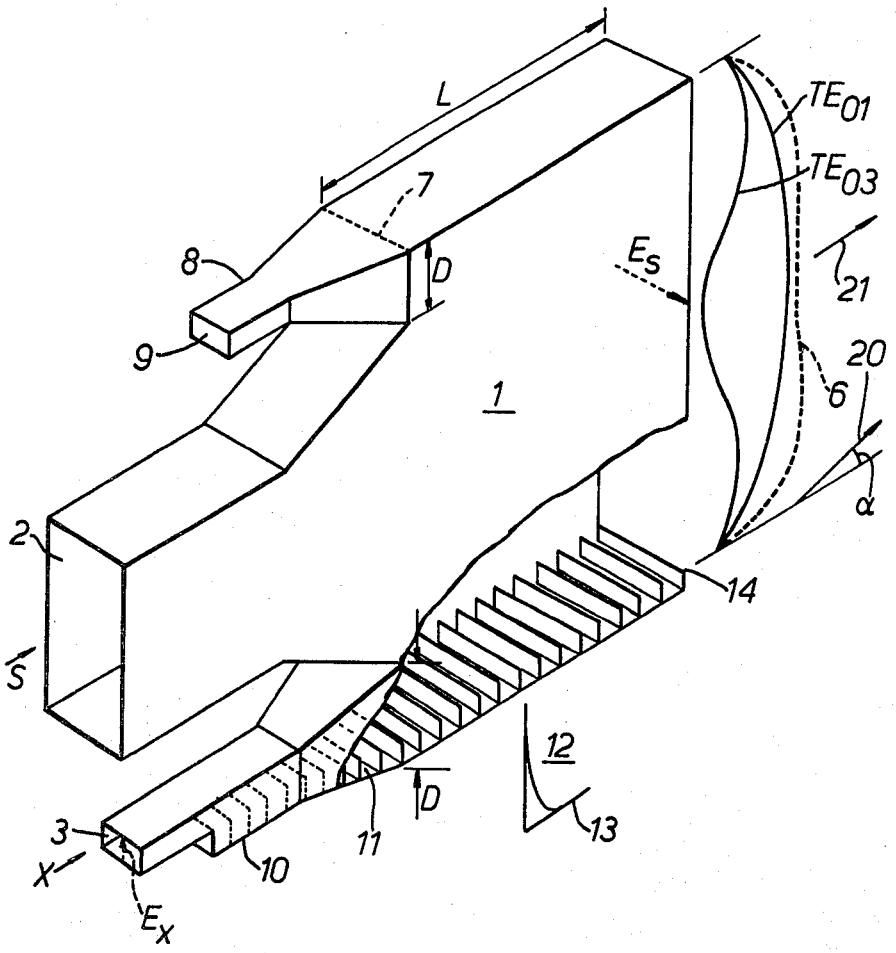
Figure 2:
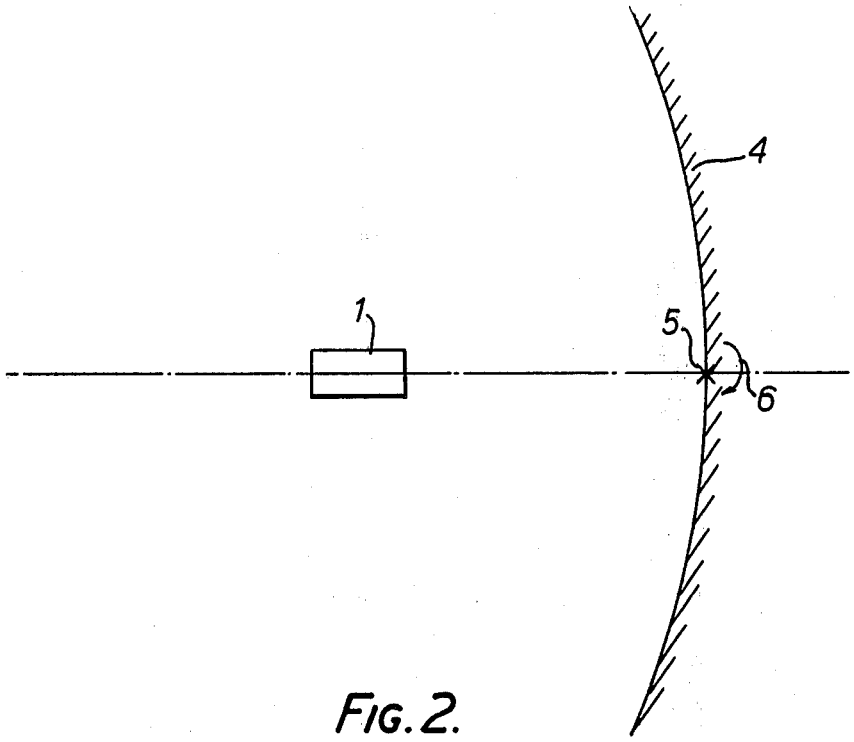
Figure 3:
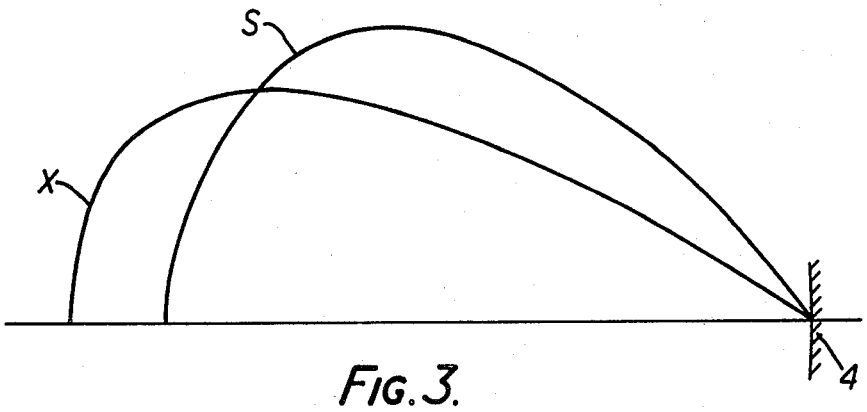

The invention is further described by way of example with reference to the accompanying drawings, in which FIG. 1 shows part of an antenna in accordance with the present invention and FIGS. 2 and 3 are explanatory diagrams.

Referring to the drawings, a box horn 1 is provided with two input ports 2 and 3, the first of which receives S band radar frequencies and the second of which receives X band radar frequencies. S band radar frequencies are generally used for surveillance purposes and are centred on a frequency of about 3 GHz. These frequencies are suitable for long range surveillance purposes such as monitoring the movement of distant aircraft. X band frequencies are more suitable for short range purposes as they are in the frequency 8 GHz to 10 GHz approximately. In both cases, the frequency values are only very approximate and depending on the precise application, the frequencies may differ somewhat. X band radar is commonly used aboard ships for navigation purposes, but is not really suitable for very long range work. The box horn 1 is mounted at the focus of a reflector 4, which is arranged to rotate in azimuth about an axis 5 in the direction indicated by the arrow 6.

Box horn antenna feeds are themselves well known and for certain applications they are more satisfactory than a simple horn feed in that the box horn supports both the $TE_{01}$ and the $TE_{03}$ modes. These modes are indicated diagrammatically in FIG. 1 and their transmitted resultant is indicated by the broken line 6. The direction of the electric field is shown by the arrow $E_s$. It will be appreciated that by choosing the relative amplitudes of these two modes, the profile of the resultant 6 can provide more uniform illumination of the surface of the reflector 4, and the use of both modes enables the antenna feed to be positioned more closely to the reflector 4 than would otherwise be the case. The box horn 1 is, of course, dimensioned so as to ensure the generation of the correct modes. The $TE_{03}$ mode is generated at the plane 7, which is dimensioned to present a purely reactive impedance to the $TE_{01}$ mode. A short length of waveguide 8 is provided with a short circuit plate 9 at its inner end and the cross section dimension of the waveguide 8 is such as to present a purely reactive impedance at the plane 7 to the $TE_{01}$ mode. In this respect, the box horn 1 is symmetrical about its central axis. The height "0" of the waveguide 8 is the relevant dimension and is made too small to support propagation of the S band frequencies. If desired the plate 9 can be omitted.

The X band signal is received at the port 3 and is converted into a surface wave within a waveguide 10 by the provision of transverse ribs 11. In a surface wave the energy distribution of the signal decays rapidly at distances away from the surface itself and a typical energy distribution is illustrated at 12 with the line 13 representing the boundary wall 14 of the box horn aperture. The profile of this energy distribution is chosen such that the energy decays to insignificant levels at a distance from the boundary wall 14 of the box horn 1 which is adjacent to the input port 3. Consequently, virtually no energy at X band is fed back into the S band input port 2. Thus a very high degree of isolation exists between the two input ports.

The direction of the electric field of the X band signals is represented by the arrow $E_x$ at the mouth of input 3 and it will be seen that it is normal to the direction of the electric field $E_s$. The energy distribution 12 is determined by the dimensions and electrical properties of the transverse ribs 11. In general, the spacing of the ribs influences the generation of the correct surface wave mode (which is the dominant mode) and the angle at which it is launched towards the reflector. Typically at least four or five ribs per wavelength are required. The depth of the ribs primarily determines the profile 12 of the energy distribution, and by varying the depth along the length of the boundary wall the distribution can be controlled.

The boundary wall 14 and the input port 3 are off-set from the central axis of the box horn, and the surface wave is launched in the direction of arrow 20 which is at an an angle $\alpha$ to this axis. The S band signal is transmitted along the central axis, as represented by the arrow 21, and the reflector 5 is positioned such a distance from the box horn 1 that radiation patterns of the kind shown in FIG. 3 are produced. The S band pattern is off-set from the horizontal plane so that it is inclined upwards from the horizon, and this is advantageous for long range surveillance radars. Despite the relative off-set in the vertical plane, the S band and X band boresights are aligned with each other in azimuth so that as the reflector 6 rotates to scan in azimuth, both radar patterns point in the same direction. The radiation patterns shown in FIG. 3 do not illustrate the same energy level contour for both bands, since in general the power level of the S band will be higher as it is used for longer range purposes.

If desired the waveguide 8 can be used to introduce a third frequency signal into the box horn, and the dimensions of the stub would be maintained so as to present the necessary purely reactive impedance at the plane 7 so as to generate the $TE_{03}$ mode of the signal applied to port 2. Additionally the length of the body of the box horn must remain such that the original $TE_{01}$ and $TE_{03}$ modes have the correct phases at the mouth of the horn so that they combine to produce the correct radiated resultant energy profile (this is shown at broken line 6).

I claim:

1. An antenna including a reflector and a box horn positioned at a focus of said reflector so as to illuminate it, the body of the box horn being dimensioned to support the $TE_{01}$ and $TE_{03}$ modes of a signal applied to a first input port thereof and to direct the resultant signal towards said reflector; and a second input port off-set from the axis of the box horn and being arranged to accept a higher frequency than said first port, one wall of the box horn being arranged to launch said higher frequency as a surface wave directed towards said reflector.

2. An antenna as claimed in claim 1 and wherein said $TE_{03}$ mode is generated by the provisions of waveguide stubs positioned symmetrically on opposite sides of said first input port and which have a transverse dimension which is too small to support the $TE_{01}$ mode.

3. An antenna as claimed in claim 2 and wherein one of the waveguides forms part of the second input port, which is dimensioned so as to be incapable of supporting the frequency of the signal applied to the first input port.

4. An antenna as claimed in claim 3 and wherein said wall which launches the surface wave comprises a plurality of transverse ribs which extend from the interior of the stubs forming part of the second input port into the body of the box horn.

5. An antenna as claimed in claim 4 and wherein the transverse ribs in the region of said stub are so dimensioned that the energy of the surface wave decays at distances away from said one wall so that the signal applied to said second input port is not coupled into said first input port.

6. An antenna as claimed in claim 1 and wherein said reflector is rotatable in azimuth, and wherein the two signals applied to said first and second input ports are reflected with boresights aligned in azimuth but angularly displaced in elevation.

* * * * *